US007814699B2

(12) United States Patent
Storch et al.

(10) Patent No.: US 7,814,699 B2
(45) **Date of Patent: *Oct. 19, 2010**

(54) MULTIPLE SIGHT GUN SIGHT ASSEMBLY

(76) Inventors: Troy Storch, 2323 Patrick La., Waukesha, WI (US) 53188; William Orne, III, 2525 S. 162nd St., New Berlin, WI (US) 53151

( * ) Notice: Subject to any disclaimer, the term of this patent is extended or adjusted under 35 U.S.C. 154(b) by 50 days.

This patent is subject to a terminal disclaimer.

(21) Appl. No.: 11/856,997

(22) Filed: Sep. 18, 2007

(65) Prior Publication Data

US 2009/0071056 A1 Mar. 19, 2009

(51) Int. Cl.
*F41G 1/00* (2006.01)

(52) U.S. Cl. ..... 42/137; 42/138; 42/140; 42/141

(58) Field of Classification Search ..... 42/138, 42/140, 141

See application file for complete search history.

(56) References Cited

U.S. PATENT DOCUMENTS

| | | | | | |
|---|---|---|---|---|---|
| 396,043 | A | * | 1/1889 | Lyman | 42/140 |
| 737,677 | A | | 9/1903 | Tansley | |
| 861,652 | A | | 7/1907 | Hawkins | |
| 1,454,865 | A | | 5/1923 | Seely | |
| 2,044,855 | A | * | 6/1936 | Lundgren | 42/137 |
| 2,331,903 | A | * | 10/1943 | Garand | 42/140 |
| 2,437,363 | A | * | 3/1948 | Smith | 42/140 |
| 2,444,038 | A | * | 6/1948 | Garand | 42/140 |
| 2,479,886 | A | | 8/1949 | Whittemore | |
| 2,585,933 | A | * | 2/1952 | Harvey | 42/137 |
| 3,851,400 | A | | 12/1974 | Michalak | |
| 4,017,995 | A | | 4/1977 | Hughes, Jr. | |
| 4,038,521 | A | | 7/1977 | Baumann | |
| 4,193,334 | A | | 3/1980 | Jackson | |
| 4,200,989 | A | | 5/1980 | Brouthers | |
| 4,577,546 | A | | 3/1986 | Jackson | |
| 4,628,611 | A | | 12/1986 | Ruffino | |
| 4,734,989 | A | * | 4/1988 | Sanders | 42/137 |
| 4,745,698 | A | | 5/1988 | Schwulst | |
| 4,859,058 | A | * | 8/1989 | Ekstrand | 356/251 |
| 4,977,676 | A | | 12/1990 | Toupin | |
| 5,171,933 | A | | 12/1992 | Eldering | |
| 5,522,166 | A | | 6/1996 | Martel | |
| 5,533,292 | A | * | 7/1996 | Swan | 42/123 |
| 5,561,910 | A | | 10/1996 | Maynard | |
| D406,303 | S | | 3/1999 | Ramsey | |
| 6,058,615 | A | | 5/2000 | Uhlmann et al. | |
| 6,199,286 | B1 | | 3/2001 | Reed, Jr. et al. | |
| 6,418,632 | B1 | | 7/2002 | Kalfayan | |
| 6,460,447 | B1 | | 10/2002 | Meyers et al. | |
| 6,477,778 | B1 | | 11/2002 | Lorocco | |

(Continued)

*Primary Examiner*—Troy Chambers
*Assistant Examiner*—Samir Abdosh
(74) *Attorney, Agent, or Firm*—Boyle Fredrickson, S.C.

(57) ABSTRACT

A system and method for providing multiple sights includes a number of sights that are attached to a sight assembly. The sight assembly is securable to a firearm and configured such that a shooter can selectively utilize one of the number of sights tailored for number of respective distances. Preferably, the sights are connected such that moving one sight out of a shooting line of sight brings another sight into the shooting line of sight. Such a sight assembly allows a shooter to quickly configure a firearm for accurate shooting at a variety of distances.

25 Claims, 4 Drawing Sheets

U.S. PATENT DOCUMENTS

| | | | | |
|---|---|---|---|---|
| 6,615,530 | B2 * | 9/2003 | Johansson | 42/133 |
| 6,622,415 | B1 | 9/2003 | Canaday et al. | |
| 6,678,987 | B2 | 1/2004 | Howe | |
| 6,684,551 | B2 | 2/2004 | Howe | |
| 6,708,597 | B2 | 3/2004 | Meyers et al. | |
| 6,732,467 | B1 * | 5/2004 | Luth | 42/138 |
| 6,779,290 | B1 * | 8/2004 | Houtsma | 42/148 |
| 6,868,614 | B2 | 3/2005 | Floied et al. | |
| 6,886,287 | B1 | 5/2005 | Bell et al. | |
| D508,726 | S | 8/2005 | Storch | |
| 7,076,907 | B2 | 7/2006 | Nesseth et al. | |
| 7,089,845 | B2 | 8/2006 | Friedli et al. | |
| 7,140,142 | B2 | 11/2006 | Ballard | |
| 7,216,451 | B1 | 5/2007 | Troy | |
| D546,916 | S * | 7/2007 | Schwerman et al. | D22/109 |
| 7,356,962 | B2 * | 4/2008 | Swan | 42/147 |
| 2003/0131518 | A1 | 7/2003 | Komberger | |
| 2004/0025398 | A1 | 2/2004 | Howe | |
| 2005/0188602 | A1 * | 9/2005 | Swan | 42/147 |
| 2005/0229468 | A1 | 10/2005 | Zaderey et al. | |
| 2006/0005450 | A1 * | 1/2006 | Nesseth et al. | 42/140 |
| 2006/0010756 | A1 | 1/2006 | Ballard | |
| 2006/0177218 | A1 | 8/2006 | Moulton | |
| 2006/0207157 | A1 * | 9/2006 | Keng | 42/132 |

* cited by examiner

MULTIPLE SIGHT GUN SIGHT ASSEMBLY

BACKGROUND OF THE INVENTION

The present invention relates generally to a firearm sight and, more particularly, to a sight assembly having multiple independent oculars or sights.

Fire arm sight assemblies generally include an ocular or sight that is attached to the firearm to assist the shooter with aligning the bore of the firearm with an intended target. Commonly, the shooter adjusts either the sight relative to the firearm, or the orientation of the sight relative to the target, to accommodate different shooting conditions. For example, if a projectile will be subjected to a crossing wind during the travel of the projectile to the target, the shooter can lateral translate the sight relative to the bore of the firearm, or simply aim the firearm at a sight that is offset from an intended projectile impact area. These variations in lateral alignment of the sight and/or the firearm with the intended target are commonly referred to as windage adjustments.

Another type of alignment adjustment the shooter must accommodate is an inclination of declination of the firearm relative to the target to accommodate the differences between the generally linear sighting path and the occasionally more curved projectile path. For targets at close range, this is generally a negligible consideration for most shooters as the projectile will follow a substantially linear path. This becomes a greater consideration for accurate shooting as the target is moved further from the firearm. In such situations, the shooter must adjust the orientation of the sight relative to the firearm or sight the firearm generally above an intended impact area. Adjusting the orientation of the sight relative to the firearm manipulates the association between the line of sight and the projectile path such that the two lines cross at the intended impact area. Aiming above a target accommodates the arcing path of the projectile such that the projectile strikes the desired impact area even though the firearm sight indicates an elevated impact area.

Regardless of the shooting technique, alignment of the sight with the firearm or estimating the degradation of the projectile path to be able to repeatedly hit an intended target is much more a skill based on experience than the simply mechanical act of firing a projectile from a firearm. Accurate shooting at various ranges under varied conditions is a skill that few shooters master. The ability to accurately hit a target is complicated by both the ambient conditions and the range between the shooter and the target. Although many adjustable gun sights are available, accurate shooting with such sights is heavily dependent on the shooters ability to orient the sight relative to the firearm to strike the intended target. Accordingly, it is desired to provide a firearm sight that can quickly and repeatably align the firearm with an intended target.

The problems associated with the aiming of the firearm mentioned above are magnified as the operable range of the firearm increases. Small misalignments of the firearm relative to a distant target will yield unintended or undesired impacts. High-power firearms, such as a .50 caliber firearm, have the potential to accurately deliver a projectile generally in a range of approximately 2000 yards or approximately 1830 meters. Coupled with the ability to deliver various projectile types such as armor-piercing rounds, incendiary munitions, and explosive rounds, such firearms are an invaluable deterrent to malevolent activities. The ability to accurately deliver projectiles throughout the operable range of such firearms provides the additional advantage of maintaining a spacing between the intended target and the shooter thereby providing a degree of protection for the shooter from debris or other projectiles which may originate from the target independently or as a result of the impact of the shooters projectile.

Understandably, efficient utilization of such high-power firearms depends heavily on the ability to quickly and efficiently train new shooters in the shooting characteristics of such firearms. Depending on a given shooters prior experience, even with the assistance of known shooting aids, the ability to train a shooter to accurately acquire and fire upon a variety of targets within a 2000 yard operating range of a firearm can be a time consuming and expensive endeavor. Accordingly, it would also be desirable to provide a firearm sight assembly that is simple to use and whose operation can be quickly understood.

It would therefore be desirable to have a system and method for providing a firearm sight assembly that is easy to operate and capable of quickly and accurately aligning the firearm projectile path with targets at varying ranges.

BRIEF DESCRIPTION OF THE INVENTION

The present invention provides a system and method of providing a firearm sight assembly that overcomes one or more of the aforementioned drawbacks. The firearm sight assembly includes a number of sights in a common assembly. The sight assembly according to one aspect of the invention is securable to a firearm and configured such that a shooter can selectively utilize one of the number of sights tailored for a number of respective distances. Preferably, the sights are connected such that moving one sight out of a shooting line of sight brings another sight into the shooting line of sight. Such a sight assembly allows a shooter to quickly configure a firearm for accurate shooting at a variety of distances.

Another aspect of the invention discloses a sight assembly having a base for securing the sight assembly to a firearm. A housing is attached to the base and a first and second sight are attached to the housing. The first sight and the second sight are constructed to rotate about a common axis that is offset and inclined relative to a generally horizontal plane that passes through a bore of the firearm. Such a sight assembly equips a user with a sight that is operable at a variety of distances with minimal manipulation.

A further aspect of the invention discloses a gun sight assembly having a first portion for engaging a firearm and a second portion for engaging the first portion. A number of sights are connected to a hub and oriented in a generally cone shape. A pivot is engaged with the hub and rotationally connects the number of sights to the second portion such that each of the number of sights can rotate between a use position and a stored position. Such a construction provides a sight assembly that is simple to operate and can be efficiently implemented across a range of firearm products.

Yet another aspect of the invention discloses as a method of providing a firearm sight. The method includes providing a frame for being connected to a firearm. A mount is provided that engages the frame. A first sight and a second sight are provided and connected to the mount such that a position of the first sight is fixed relative to the second sight and such that the first sight and the second sight can rotate about an axis that crosses a target sight line through one of the first sight and the second sight. Such a sight assembly can be efficiently produced, provides for repeatable sight position, and is robust and can withstand harsh operating conditions.

These and various other aspects, features, and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
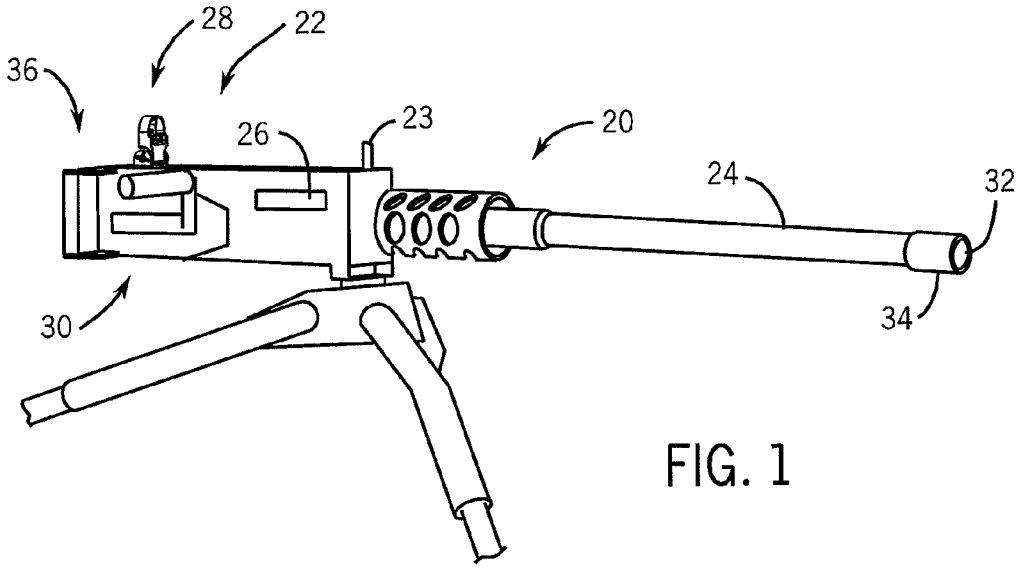
FIG. 1 is a perspective view of a firearm equipped with a sight assembly according to the present invention.

FIG. 1 shows a firearm 20 equipped with a sight system or assembly 22 according to the present invention. Firearm 20 includes a barrel portion 24 and a stock or action portion 26. It is appreciated that although firearm 20 is shown as a generally high-power, large caliber firearm, such as a .50 caliber firearm that can be configured for single shot, semiautomatic, or fully automatic operation, sight assembly 22 is operable with virtually any firearm assembly wherein sighting at varied ranges is desired. It is further appreciated that, although sight assembly 22 is shown as being positioned proximate a rearward portion 28 of firearm 20, sight assembly 22 could be secured to any portion of the firearm or supporting structure provided sight assembly 22 moves generally with firearm 20.

Firearm 20 includes an action 30 having a firing pin constructed to impact a primer cartridge of a shell. Upon discharge of the shell, a projectile is accelerated and travels through a bore 32 of firearm 20. The projectile exits bore 32 proximate a muzzle 34. Once fired, the projectile follows a projectile path to an intended target. As is commonly understood from projectile dynamics, after leaving bore 32, the projectile gradually slows until impact with interfering objects. As previously discussed, the ability to impact a desired target with the projectile depends greatly on a shooters ability to align bore 32 of firearm 20 such that the projectile follows a projectile path that crosses the intended target.

Figure 2:
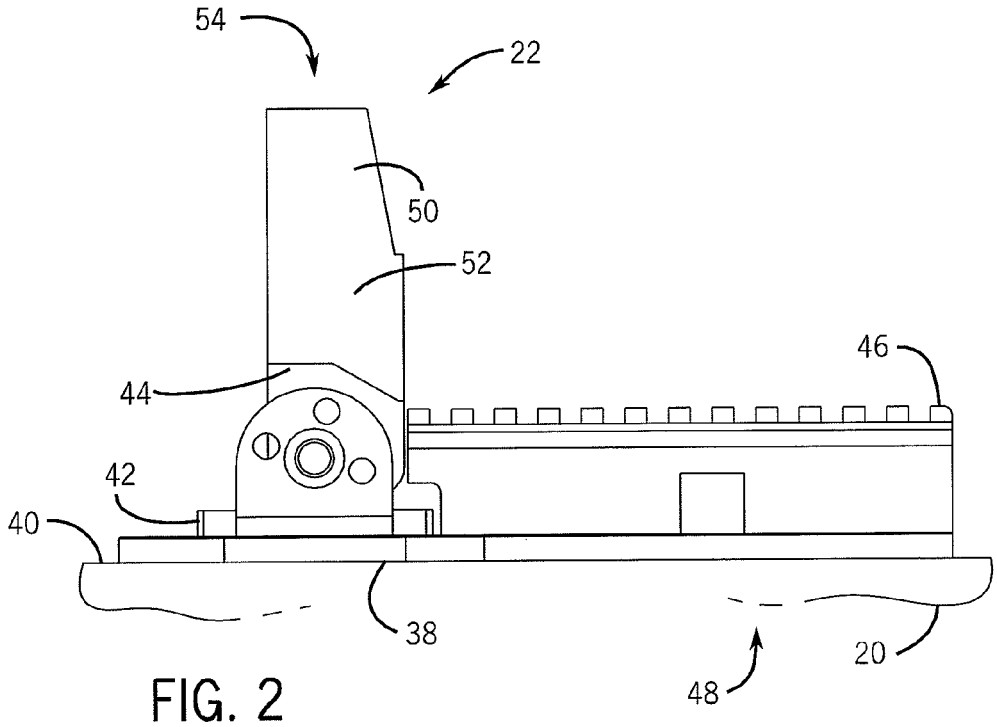
FIG. 2 is a side elevational view of the sight assembly shown in FIG. 1.

A shooter position 36 is located generally behind firearm 20 such that a shooters line of sight is generally aligned with a vertical plane associated with the desired projectile path. A shooter utilizes sight assembly 22 and a forward post sight 23 to align bore 32 such that the projectile impacts a desired target. As shown in FIG. 2, sight assembly 22 is secured to a bracket 38 that engages a top plate or an upper surface 40 of firearm 20. Sight assembly 22 includes a first portion, frame, or base 42 and a second portion, mount, sight mount, or housing 44 that is pivotably connected to base 42. An optional rail 46 is constructed to engage a forward portion 48 of bracket 38 such that optional rail 46 is also secured to firearm 20 and generally aligned with the bore thereof. Optional rail 46 is constructed to cooperate with other sighting accessories, such as magnifying scopes, laser aiming devices, etc. It is appreciated that optional rail 46 include one or more vertically oriented rail sections and/or one of more of a variety of additional aiming implements. It is further appreciated that sight assembly 22 be operable to interact with other supplemental sight systems such as a front sight post secured to the firearm or the like.

Figure 3:
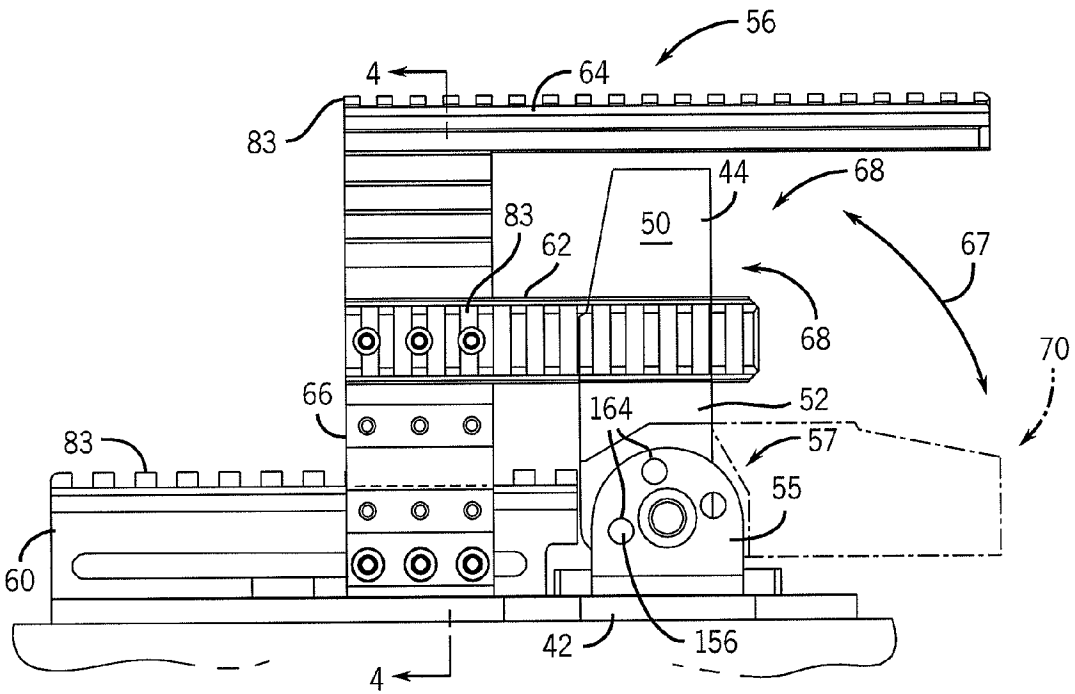
FIG. 3 is a view similar to FIG. 2 of an opposite side of the sight assembly with another optional accessory rail system positioned about the sight assembly.

FIG. 3 shows another optional rail system 56 that is useable with sight assembly 22. Rail system 56 includes a number of rails 60, 62, 64 that are connected by a rail mounting member 66. Housing 44 of sight assembly 22 is pivotably connected to base 42 to be rotatable, indicated by arrow 67, between an in-use position 68 and a non-use or stored position 70, shown in phantom. Housing 44 is constructed to move between in-use position 68 and stored position 70 without otherwise interfering with rails 60, 62, 64 or accessories attached thereto.

Figure 4:
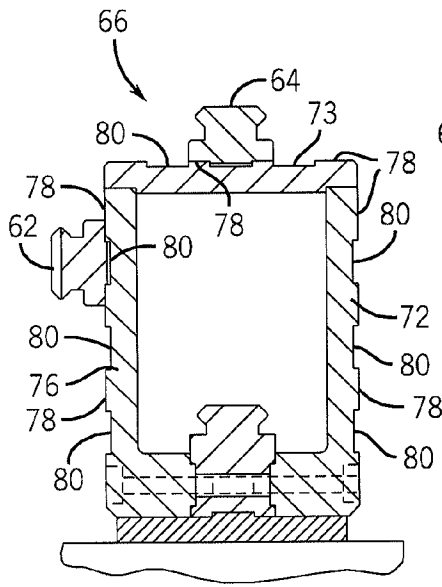
FIG. 4 is a cross-sectional view of a mount frame of the optional accessory rail taken along line 4-4 shown in FIG. 3.

As shown in FIG. 4, optional rail mounting member 66 includes a number of side sections 72, 73, 76 that include a number of lands and grooves 78, 80 for cooperatively engaging a respective rail 60, 62, 64. Lands and grooves 78, 80 further provide for securing one or more rails to mounting member 66 and/or altering or otherwise uniquely configuring the rails to the preferences of a particular user. Oppositely facing side sections 72, 76 of mounting member 66 are constructed to engage rail 60 such that mounting member 66 is rigidly securable to firearm 20. Rails 62, 64 are secured to mounting member 66 such that accessories engaged with rails 62, 64 are robustly secured to firearm 20. Accordingly, optional rail system 56 provides for securing sighting or other targeting acquiring accessories to firearm 20 and enhances the functionality of sight assembly 22 and/or a firearm equipped therewith.

Referring back to FIG. 3, each rail 60, 62, 64 also includes a number of ribs 83 constructed to interact with sighting accessories for securing the accessories at a desired location and to a desired rail 60, 62, 64. Such a construction ensures the approximate alignment of the accessory with bore 32 of firearm 20 thereby reducing and simplifying the set-up and operation associated with any given sighting accessory. Furthermore, the clearance between sight assembly 22 and optional rail system 56 reduces the time and effort associated with configuring and reconfiguring firearm sighting systems.

Figure 5:
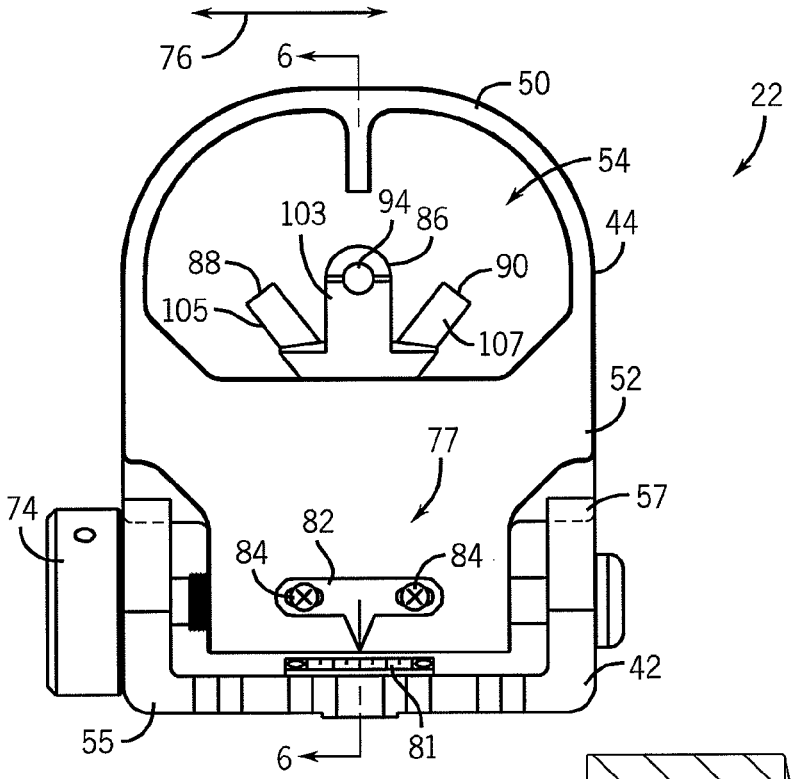
FIG. 5 is a rear elevational view of the sight assembly shown in FIG. 2.

Referring to FIGS. 3 and 5, housing 44 of sight assembly 22 includes a hoop 50 that extends from a body 52 and generally forms a sight window 54 therebetween. Base 42 includes a first arm 55 and a second arm 57 that are positioned at generally opposite ends of base 42. A number of passages 164 are formed through arms 55, 57 and cooperate with an indexer or pin 158, 160 configured to provide a tactile indication that housing 44 has achieved the in-use or stored positions 68, 70, respectively. The interfering engagement between indexer 158, 160 and passages 164 further ensures that housing 44 does not unintentionally move from a desired or intended position.

As shown in FIG. 5, a dial or windage adjustment dial 74 is positioned proximate one of arms 55, 57. Manipulation of dial 74 translates housing 44 relative to base 42 in a lateral direction, indicated by arrow 76, with respect to bore 32 of firearm 20. Lateral translation of housing 44 relative to base 42 is commonly understood as providing a windage adjustment of sight assembly 22. Moving housing 44 to the right relative to base 42, translates bore 32 in the same direction relative to a shooters line of sight. Lateral translation of housing 44 relative to base 42 laterally aligns a shooters line of sight with a projectile path as a particular distance.

Sight assembly 22 further includes a lateral position indicator assembly or stadia indicator 77. Stadia indicator 77 includes a reference marker 81 secured to base 42 and an indicator 82 secured to housing 44. Indicator 82 is secured to housing 44 by a number of fasteners 84 such that a position of indicator 82 can be associated with reference marker 81. Such a construction allows indicator 82 to be oriented relative to reference marker 81 to provide a "zero-out" calibration or adjustment or provide an indication of a projectile path under no or minimal windage conditions. Stadia indicator 77 provides a shooter with a visual indication of the translation of housing 44 relative to base 42 relative to the zeroed orientation.

Figure 6:
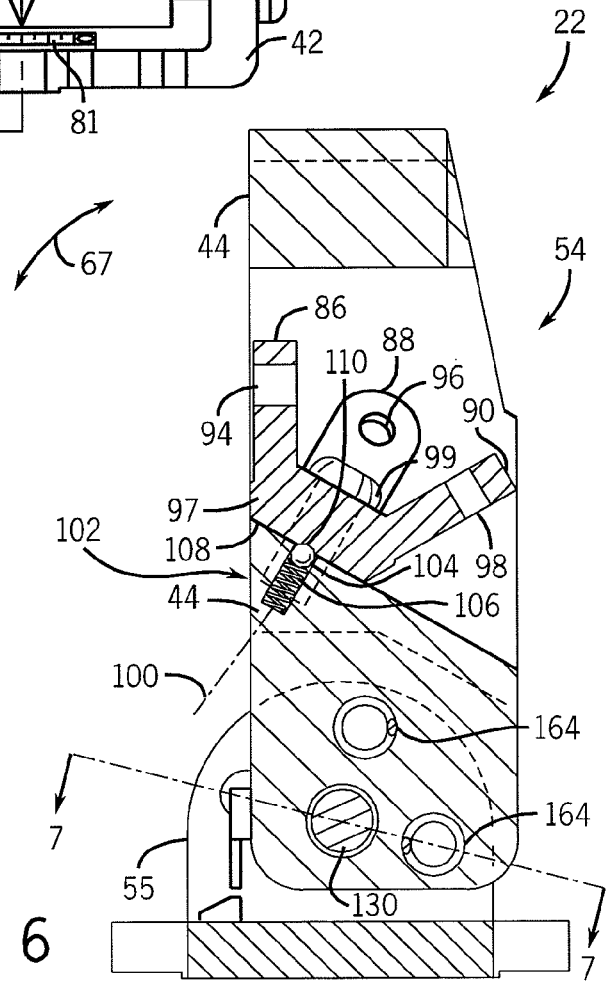
FIG. 6 is a cross-sectional view of the sight assembly shown in FIG. 5 and taken along line 6-6 shown in FIG. 5.

Referring to FIGS. 5 and 6, a number of sights 86, 88, 90 are secured to housing 44 and generally positioned within sight window 54. Each sight 86, 88, 90 includes in a target window or opening 94, 96, 98. The target window 94, 96, 98 of each sight 86, 88, 90 is offset from an axis of rotation by an arm 103, 105, 107 relative to a shooters line of sight. The length of arms 103, 105, 107 and the size of the corresponding target window 94, 96, 98, defines an orientation of the shooters line of sight to a target and the inclination or declination of the bore of firearm 20. That is, arms 103, 105, 107 provide a varied offset of target windows 94, 96, 98 relative to bore 32 of firearm 20 such that, when the shooters line of sight is aligned with the target, the projectile path and the line of sight intersect at the target.

Each of sights 86, 88, 90 is associated such that sight assembly 22 can be utilized for accurate targeting of intended targets within an operable range of firearm 20. Preferably, sight 86 is configured to accurately align firearm 20 with targets at approximately 1000 yards or roughly 915 meters from firearm 20, sight 88 is configured to accurately align firearm 20 with targets between 500 yards or 450 meters and 800 yards or 730 meters, and sight 90 is configured to accurately align firearm 20 with targets nearer than approximately 500 yards or 450 meters. Sight assembly 22 clearly provides a highly versatile sight assembly that is operable across a majority of the common operating range of firearm 20. Understandably, these sight operation ranges are merely exemplary and other sight ranges are envisioned.

Preferably, sights 86, 88, 90 are rigidly connected to one another by a hub portion 97 such that sights 86, 88, 90 are oriented in a generally conical shape and connected such that movement of one sight results in movement of the remaining sights. To configure firearm 20 for shooting at targets at any of a variety of ranges, a shooter simply need position the desired sight 86, 88, 90 within sight window 54. It is appreciated that although three sights are shown, other sight configurations and constructions are envisioned. For example, it is envisioned that two or more than three sights may be provided and the sights provided may be configured with no or differing ranges of overlap. It is further envisioned that the sights and hub be separable but configured to interact when assembled. Such a construction allows a user to uniquely configure a sight assembly for a desired use.

As shown in FIG. 6, a pivot 99 passes through hub portion 97 and engages housing 44. Pivot 99 secures sights 86, 88, 90 to housing 44 such that sights 86, 88, 90 are rotatable with respect to housing 44. Sights 86, 88, 90 rotate about pivot 99 to position a respective sight in an in-use position. As shown in FIG. 5, sight 86 is orientated in the in-use position whereas sights 88, 90 are positioned in a stored or non-use position. Rotation of hub 97 about pivot 99 translates sights 86, 88, 90 such that a desired sight is positioned in the in-use position. Accordingly, sight assembly 22 can be configured for use of any of sights 86, 88, 90 simply by rotating the sights and hub portion 97 about pivot 99.

Referring back to FIG. 6, pivot 99 provides an axis of rotation 100 of sight 86, 88, 90 that is offset and inclined relative to a horizontal plane passing through bore 32 of firearm 20 associated with the use of sight assembly 22. Preferably, axis 100 of pivot 99 forms an axis of rotation of sights 86, 88, 90 that is generally aligned but skewed relative to bore 32 of firearm 20. That is, preferably axis 100 extends in a direction that is aligned with bore 32 and oriented in a crossing direction relative to bore 32. The generally unobstructed movement of sights 86, 88, 90 relative to housing 44 provides a robust sight assembly that can withstand harsh operating environments. Furthermore, the positioning of sights 86, 88, 90 within a cross-sectional footprint of housing 44 protects sights 86, 88, 90 from unintended impacts or other undesired adjustments.

An indexer assembly 102 includes a ball 104 and a spring 106. Spring 106 is constructed to bias ball 104 into an underside 108 of hub 97. Ball 104 cooperates with a number of detents 110 formed in underside 108 of hub 97. The cooperation of ball 104 with detents 110 provides a tactile indication that a respective sight 86, 88, 90 is positioned in the in-use position. Indexer assembly 102 further ensures hub 97 and sights 86, 88, 90 are maintained in a desired orientation until a user desires use of an alternative sight 86, 88, 90.

Figure 7:
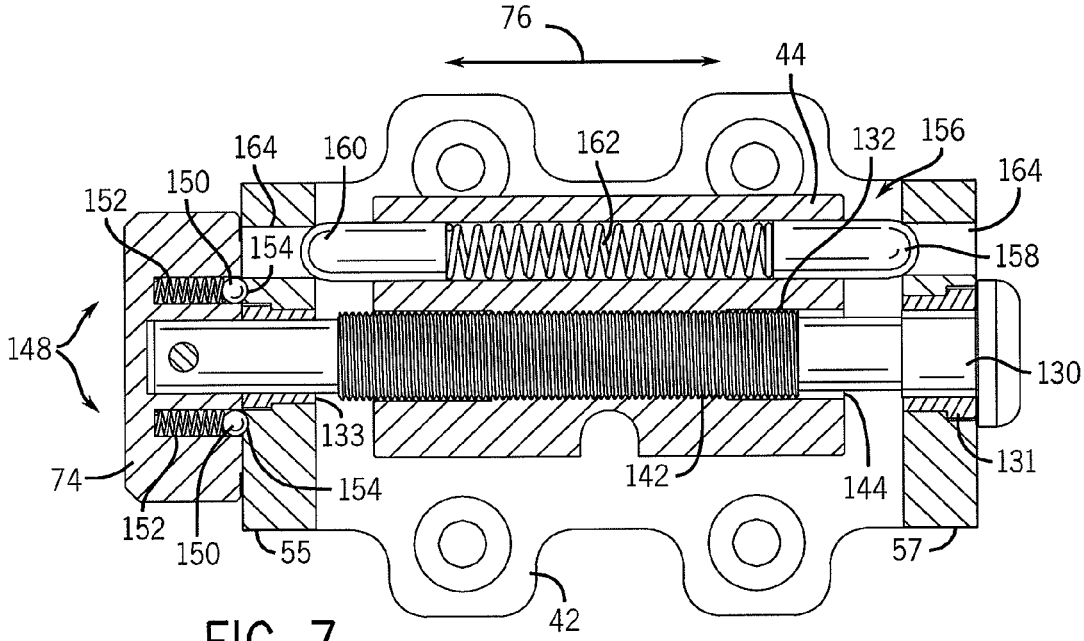
FIG. 7 is a cross-sectional view of the sight assembly shown in FIG. 2 and taken along line 7-7 shown in FIG. 3.

Referring to FIGS. 6 and 7, housing 44 is rotatable relative to base 42 in direction 67 about shaft 130. Opposing ends of shaft 130 are rotationally supported by a bushing 131, 133 associated with each arm 55, 57 of base 42. Dial 58 is fixedly secured to shaft 130 such that rotation of dial 58 rotates shaft 130. Rotation of shaft 130 rotates a threaded portion 132 of shaft 130 that is engaged with a threaded surface 142 of a passage 144 formed through housing 44. Rotation of shaft 130 results in lateral translation, indicated by arrow 146, of housing 44 relative to base 42. Accordingly, rotation of dial 58 laterally translates housing 44, and thereby sights 86, 88, 90, relative to bore 32 of firearm 20.

As shown in FIG. 7, a number of indexers 148 are disposed between dial 58 and arm 55 of base 42. Each indexer 148 includes a ball 150 and a spring 152. Springs 152 bias balls 150 into corresponding detents 154 formed in arm 55. Indexers 148 provide a tactile indication of the relative translation of housing 44 relative to base 42. Another passage 156 is formed through housing 44 and receives a pair of positioning pins 158, 160 and a spring 162 disposed between the positioning pins 158, 160. Positioning pins 158, 160 and spring 162 do not interfere with the lateral translation of housing 44 relative to base 42. Spring 162 biases pins 158, 160 into engagement with a corresponding opening 164 formed in each arm 55, 57, respectively.

Referring to FIGS. 3 and 7, the engagement of pins 158, 160 with arms 55, 57 secures housing 44 relative to base 42 in the in-use position 68 and the stored position 70, respectively, as shown in FIG. 3. Manipulation of housing 44 relative to base 42 forces pins 158, 160 to retract from openings 164 thereby compressing spring 162. When pins 158, 160 are retracted from openings 164, housing 44 is allowed to rotate about shaft 130 relative to base 42. As shown in FIG. 3, when rotated to the stored position, pins 158, 160 engaged the higher of holes 164 formed in arm 55 and when rotated to the in-use position, pins 158, 160 engage the lower of holes 164. Such a construction allows housing 44 to be secured in either the in-use position 68 or the stored position 70 relative to base 42, respectively. Furthermore, such a construction allows housing 44 to be repeatably positioned in either the in-use or stored positions. Pins 158, 160, spring 162, and recesses or openings 164 are further configured to be operable over the entire range of lateral movement housing 44 relative to base 42 associated with the windage adjustment. Accordingly, regardless of the instantaneous orientation of housing 44 relative to base 42, sight assembly 22 can be quickly converted for use and/or storage.

The sight assembly 22 according to the present invention provides a gun sight system that allows a shooter to quickly and repeatably configure the firearm for shooting at various distances. Sight assembly 22 is further configured for generally seamless integration into any of a number of firearm constructions. Sight assembly 22 can also be integrated or augmented and/or supplemented with the use of other sighting accessories such as scopes, lasers, target magnifiers, or the like. The robust construction of sight assembly 22 ensures product longevity and the ability to withstand the inhospitable conditions frequently associated with use of such firearms. Sight assembly 22 is further constructed to be simple to operate such that novice shooters can quickly become accurate marksman across at least a substantial portion of a tactical range of any firearm equipped with such a system.

Therefore, one embodiment of the invention includes sight assembly having a base for securing the sight assembly to a firearm. A housing is attached to the base and a first and second sight are attached to the housing. The first sight and the second sight are constructed to rotate about a common axis that is offset and inclined relative to a generally horizontal plane that passes through a bore of the firearm.

Another embodiment includes a gun sight assembly having a first portion for engaging a firearm and a second portion for engaging the first portion. A number of sights are connected to a hub and oriented in a generally cone shape. A pivot is engaged with the hub and rotationally connects the number of sights to the second portion such that each of the number of sights can rotate between a use position and a stored position.

A further embodiment includes a method of providing a firearm sight that includes providing a frame for being connected to a firearm. A mount is provided that engages the frame. A first sight and a second sight are provided and connected to the mount such that a position of the first sight is fixed relative to the second sight and such that the first sight and the second sight can rotate about an axis that crosses a target sight line through one of the first sight and the second sight.

The present invention has been described in terms of the preferred embodiment, the several embodiments disclosed herein are related as being directed to the assembly as generally shown in the drawings. It is recognized that equivalents, alternatives, and modifications, aside from those expressly stated, the embodiments summarized, or the embodiment shown in the drawings, are possible and within the scope of the appending claims. It is further appreciated that aspects of the multiple embodiments are not specific to any of the particular embodiment and may be applicable between one or more of the disclosed embodiments. The appending claims cover all such alternatives and equivalents.

What is claimed is:

1. A sight assembly comprising:

a base for securing the sight assembly to a firearm;

a housing attached to the base;

a first sight attached to the housing and constructed to rotate about an axis that is tilted with respect to both a vertical axis and relative to a generally horizontal plane that passes through a bore of the firearm; and a second sight attached to the housing and constructed to rotate about the axis.

2. The sight assembly of claim 1 further comprising a third sight attached to the housing and constructed to rotate about the axis.

3. The sight assembly of claim 2 wherein the first sight is calibrated to align the firearm with a target within 500 meters from the firearm, the second sight is calibrated to align the firearm with a target generally between 500 and 800 meters from the firearm, and the third sight is calibrated to align the firearm with a target between 800 meters and 1000 meters from the firearm.

4. The sight assembly of claim 1 wherein the first sight and the second sight are attached such that rotation of one sight rotates the other sight.

5. The sight assembly of claim 1 further comprising a loop extending from the housing and constructed such that the first sight and the second sight can rotate thereunder.

6. The sight assembly of claim 1 further comprising a windage adjuster constructed to translate the housing relative to the base in a direction generally transverse to a barrel of the firearm.

7. The sight assembly of claim 1 wherein the firearm is constructed to fire an approximately .50 caliber projectile.

8. The sight assembly of claim 1 wherein the housing is pivotably connected to the base such that the housing is movable between an in-use position and a stored position.

9. The sight assembly of claim 1 wherein at least one of the first sight and the second sight includes a generally circular opening that is offset from the axis by a stem that extends in a crossing direction relative to the axis.

10. The sight assembly of claim 9 wherein the first sight includes an opening of a first size and the second sight includes an opening of another size.

11. A gun sight assembly comprising:

a first portion for engaging a firearm;

a second portion for engaging the first portion;

a number of sights connected to a hub and oriented in a generally cone shape; and a pivot engaged with the hub for rotationally connecting the number of sights to the second portion such that each of the number of sights can rotate about an axis that is tilted in a vertical direction relative to a horizontal plane that contains a bore of the firearm between a use position and a stored position.

12. The gun sight assembly of claim 11 wherein the pivot is generally aligned with an axis of the generally cone shape.

13. The gun sight assembly of claim 11 wherein the number of sights includes a first sight associated with a first range to target, a second sight associated with a second range to target, and a third sight associated with a third range to target.

14. The gun sight assembly of claim 13 wherein the at least two of the first, second, and third ranges to target overlap.

15. The gun sight assembly of claim 11 further comprising a windage adjuster constructed to translate the second portion relative to the first portion such that the second portion translates laterally relative to a bore of a firearm.

16. The gun sight assembly of claim 11 further comprising an elevation adjuster constructed to vary a position of the pivot relative to the first portion.

17. The gun sight assembly of claim 11 further comprising a hinge constructed to allow the second portion to rotate between an in-use position and a stored position.

18. The gun sight assembly of claim 11 wherein the pivot is positioned in a common vertical plane with the bore of the firearm and oriented to extend in a crossing direction relative to a longitudinal axis of the bore.

19. A method of providing a firearm sight comprising:

providing a frame for being connected to a firearm;

providing a mount that engages the frame;

providing a first and a second sight; and connecting the first sight and the second sight to the mount such that a position of the first sight is fixed relative to the second sight and such that the first sight and the second sight can rotate about an axis that extends in a direction that is tilted relative to a horizontal plane and that is tilted relative to a vertical plane that contains a target sight line through one of the first sight and the second sight.

20. The method of claim 19 wherein the first sight and second sight are mounted at a position along the axis that is offset above a horizontal plane passing through a bore of the firearm and the axis inclines relative to the horizontal plane in a direction toward a muzzle of the firearm.

21. The method of claim 19 further comprising connecting a third sight to the mount such that a position of the third sight is fixed relative to the first and second sights.

22. The method of claim 21 wherein the first, second, and third sights are formed as one-piece having a spoke and hub configuration wherein the spokes extend in a canted direction relative to a plane of rotation of the hub.

23. The method of claim 21 wherein the one-piece orients the first, second, and third sights to rotate about the axis in a cone shape.

24. The method of claim 19 further comprising attaching the firearm sight to a firearm.

25. The method of claim 24 further comprising constructing the frame to orient the firearm sight relative to one of a forward position or a rear position of the firearm.

* * * * *